US009214049B2

(12) United States Patent
Doi et al.

(10) Patent No.: US 9,214,049 B2
(45) Date of Patent: Dec. 15, 2015

(54) VALUABLE-MEDIUM PROCESSING APPARATUS AND VALUABLE-MEDIUM PROCESSING METHOD

(75) Inventors: Kazuhiro Doi, Hyogo (JP); Minoru Higashiyama, Hyogo (JP); Atsushi Morisawa, Hyogo (JP); Koichi Nishida, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 342 days.

(21) Appl. No.: 13/148,427

(22) PCT Filed: Feb. 9, 2009

(86) PCT No.: PCT/JP2009/052168

§ 371 (c)(1),
(2), (4) Date: Aug. 8, 2011

(87) PCT Pub. No.: WO2010/089895

PCT Pub. Date: Aug. 12, 2010

(65) Prior Publication Data

US 2011/0308913 A1 Dec. 22, 2011

(51) Int. Cl.

| | |
|---|---|
| ***G07F 7/04*** | (2006.01) |
| ***G07D 11/00*** | (2006.01) |
| ***G07F 19/00*** | (2006.01) |
| ***G07D 1/00*** | (2006.01) |
| ***G07D 9/00*** | (2006.01) |

(52) U.S. Cl.

CPC ..... *G07D 11/0084* (2013.01); *G07D 1/00* (2013.01); *G07D 9/00* (2013.01); *G07D 11/0066* (2013.01);

(Continued)

(58) Field of Classification Search

CPC ..... G07D 3/00; G07D 3/02; G07D 3/06; G07D 3/128; G07D 5/00; G07D 9/008; G07D 9/04; G07D 9/06; G07D 7/00; G07D 11/00; G07D 11/0066; G07D 11/0069; G07D 11/0072; G07D 11/0075; G07D 11/0078; G07D 11/0084; G07D 11/0087; G07D 11/009; G07D 11/0093; G07D 11/0096; G07D 13/00; G07D 2207/00; G07D 2211/00; G07F 1/047; G07F 7/04; G07F 19/00; G07F 19/20; G07F 19/201; G07F 19/202; G07F 19/203; G07F 19/204; G07F 19/205; G07F 19/206; G07F 19/2055; G07F 19/207; G07F 19/208; G07F 19/209; G07F 19/21; G07F 19/211

USPC ..... 194/206, 207; 209/534; 235/379; 382/135; 356/71; 705/30, 33, 35, 39, 705/41–45; 453/1, 2, 58; 902/8–21

See application file for complete search history.

(56) References Cited

U.S. PATENT DOCUMENTS

| | | | | |
|---|---|---|---|---|
| 7,264,150 | B1 * | 9/2007 | Moreland et al. | 235/379 |
| 7,537,153 | B2 * | 5/2009 | Hurwitz et al. | 235/379 |

(Continued)

FOREIGN PATENT DOCUMENTS

| | | |
|---|---|---|
| JP | 56-065266 | 6/1981 |
| JP | 2003-123119 | 4/2003 |

(Continued)

OTHER PUBLICATIONS

European Search Report (Application No. 09839672.4—PCT/JP2009052168) (7 pages—dated Jun. 7, 2012).

*Primary Examiner* — Jeffrey Shapiro

(74) *Attorney, Agent, or Firm* — Renner, Kenner, Greive, Bobak, Taylor & Weber

(57) ABSTRACT

The complexity of a task is reduced when a user processes a valuable medium, such as sales proceeds, of a plurality of days, on a sales day basis, all at once at a later date. A valuable-medium processing apparatus includes a valuable-medium processing unit that processes a valuable medium, a storage unit that stores therein information on the valuable medium processing, a display unit that displays the information on the valuable medium processing, an input unit for inputting the information on the valuable medium processing, a display control unit that causes the display unit to display information on a no-processing day when the valuable medium was not processed by the valuable-medium processing unit, and a control unit that causes the valuable-medium processing unit to process the valuable medium on a specific no-processing day when the specific no-processing day displayed on the display unit was inputted by using the input unit.

15 Claims, 8 Drawing Sheets

(52) U.S. Cl.
CPC ..... *G07D 11/0069* (2013.01); *G07D 11/0072* (2013.01); *G07D 11/0075* (2013.01); *G07F 19/202* (2013.01); *G07F 19/203* (2013.01); *G07F 19/209* (2013.01)

(56) References Cited

U.S. PATENT DOCUMENTS

| | | | | |
|---|---|---|---|---|
| 2004/0200690 | A1* | 10/2004 | Adams et al. | 194/302 |
| 2005/0096986 | A1* | 5/2005 | Taylor et al. | 705/16 |
| 2006/0065717 | A1* | 3/2006 | Hurwitz et al. | 235/381 |
| 2006/0249568 | A1* | 11/2006 | Scanlon | 235/379 |
| 2010/0025183 | A1* | 2/2010 | Folk et al. | 194/200 |

FOREIGN PATENT DOCUMENTS

| | | |
|---|---|---|
| JP | 2007-257263 | 10/2007 |
| JP | 2008-003665 | 1/2008 |
| JP | 2008-242781 | 10/2008 |

* cited by examiner

FIG.3

CASH REGISTER No.01 · OPERATOR ID: 0101

| PROCESSING DATE | COUNTING RESULT | ERROR AMOUNT | CUMULATIVE FREQUENCY | DEPOSIT COMPLETION FLAG | ALARM FLAG |
|---|---|---|---|---|---|
| 1 | ¥XXX. XXX | 0 | 0 | 1 | 0 |
| 2 | ¥XXX. XXX | −¥XXX | 1 | 1 | 0 |
| 3 | ¥XXX. XXX | −¥XXX | 2 | 1 | 0 |
| 4 | 0 | 0 | 2 | 0 | 0 |
| 5 | ¥XXX. XXX | −¥XXX | 3 | 1 | 1 |
| ⋮ | ⋮ | ⋮ | ⋮ | ⋮ | ⋮ |

VALUABLE-MEDIUM PROCESSING APPARATUS AND VALUABLE-MEDIUM PROCESSING METHOD

TECHNICAL FIELD

The present invention relates to a valuable-medium processing apparatus and a valuable-medium processing method.

BACKGROUND ART

Conventionally, in retail stores such as department stores and supermarkets, after the day's business is over, users of cash registers installed in stores collect the day's sales proceeds from their respective cash registers, and count it by a cash processing machine installed in a predetermined back office, etc.

Generally, in devices used for counting the sales proceeds, management of the sales proceeds is done on a sales day basis. For example, a cash processing machine is disclosed in Patent Document 1 that manages the sales proceeds in the form of cash on a sales day basis, and is configured such that, when the date changes without the previous day's cash processing being terminated and without the machine being switched off, the fact is displayed on a predetermined display unit to stimulate restart of the machine by the next user. When the cash processing machine is restarted by the next user, the still open previous day's cash processing is terminated and the current day's cash processing is initiated.

By means of the cash processing machine, even if the previous day's cash processing is in an unprocessed state and is not completely terminated, the next user is able to terminate the previous day's cash processing on the following day by restarting the cash processing machine after seeing the screen on the display unit. Consequently, if the next user terminates the cash processing of the current day, the current day's cash processing is not mistakenly managed with the previous day's cash processing as previous day's cash processing.

[Patent Document 1] Japanese Patent Application Laid-open No. 4050888

DISCLOSURE OF INVENTION

Problem to be Solved by the Invention

However, the cash processing machine described in Patent Document 1 does not take into account the situation where the user may want to process the sales proceeds of a plurality of sales days, on a sales day basis, all at once at a later date. Therefore, whenever the user wants to do this, the user is required to undertake a complicated task.

For example, there are retail stores, in the overseas market, that implement a system whereby a dedicated teller deposits the sales proceeds collected from various cash registers by their respective users into a cash processing machine for counting. However, when the teller is off for a plurality of days in a row (for example, on Saturday and Sunday), a daily counting of the sales proceeds by the teller may not be possible.

To solve this issue, the sales proceeds collected from each cash register are kept in a designated safe, etc., on a sales day basis, and when the teller reports for work the next time, the sales proceeds of the days on which the teller was not working are subjected to a counting process all at once, on a sales day basis.

To initiate the counting process, for each sales day, the teller has to set the date of the cash processing machine to the date of the each sales day and have the date displayed on a screen in order to process the sales proceeds of each sales day. Thus, the task becomes a complicated one for the teller.

In the conventional cash processing machine, the operation for setting the date needs to be performed not only when depositing the collected cash, but also when dispensing a change fund to be used on the following day. Consequently, the task becomes a complicated one for the user.

It is an object of the present invention to provide a valuable-medium processing apparatus and a valuable-medium processing method by which the complexity of the task is reduced when processing valuable medium, such as the sales proceeds of a plurality of days, on a sales day basis all at once at a later date, or when dispensing the cash of a plurality of days all at once.

Means for Solving Problem

According to an aspect of the present invention, a valuable-medium processing apparatus is provided that includes a valuable-medium processing unit that processes valuable medium, a storage unit that stores therein information pertaining to processing of the valuable medium, a display unit that displays the information pertaining to the processing of the valuable medium, an input unit for inputting the information pertaining to the processing of the valuable medium, a display control unit that causes the display unit to display information pertaining to a no-processing day on which the valuable medium was not processed by the valuable-medium processing unit, and a control unit that causes the valuable-medium processing unit to process the valuable medium on a specific no-processing day when the specific no-processing day displayed on the display unit was inputted using the input unit as processing for the specific no-processing day.

According to another aspect of the present invention, the control unit causes the storage unit to store therein, in an associated form, the no-processing day that was inputted and processing results of the valuable medium processed by the valuable-medium processing unit.

According to still another aspect of the present invention, the valuable-medium processing unit counts and processes a numerical quantity and a kind of the valuable medium collected from a cash register.

According to still another aspect of the present invention, the valuable-medium processing unit counts a total amount or a total value of the valuable medium collected from the cash register.

According to still another aspect of the present invention, the valuable-medium processing apparatus includes a numerical-quantity receiving unit that receives the numerical quantity and the kind of the valuable medium, an information receiving unit that receives information pertaining to the cash register, and an error detecting unit that detects an error by comparing a counting result obtained by the valuable-medium processing unit and the numerical quantity and the kind of the valuable medium received by the numerical-quantity receiving unit. When the error was detected by the error detecting unit, the control unit causes the storage unit to store therein the information pertaining to the error and the information pertaining to the cash register of which the error was detected.

According to still another aspect of the present invention, the valuable-medium processing apparatus includes a value receiving unit that receives the total amount or the total value of the valuable medium, an information receiving unit that receives the information pertaining to the cash register, and an error detecting unit that detects an error by comparing the counting result obtained by the valuable-medium processing unit and the total amount or the total value of the valuable medium received by the value receiving unit. When the error was detected by the error detecting unit, the control unit causes the storage unit to store therein the information pertaining to the error and the information pertaining to the cash register of which the error was detected.

According to still another aspect of the present invention, the display control unit causes the display unit to display the information stored in the storage unit pertaining to the error and the information pertaining to the cash register of which the error was detected.

According to still another aspect of the present invention, the display control unit causes the display unit to display the information that is stored in the storage unit and that includes the error that exceeds a predetermined threshold value and the information pertaining to the cash register of which the error was detected.

According to still another aspect of the present invention, the valuable-medium processing unit includes a recognition unit that recognizes a deposited valuable medium, and a valuable-medium storage unit that stores therein the valuable medium recognized by the recognition unit.

According to still another aspect of the present invention, the valuable-medium processing apparatus includes the valuable-medium processing unit that dispenses the valuable medium, and a dispensing requesting unit that issues a dispensing request to the control unit for dispensing of the valuable medium. The control unit, upon receiving the no-processing day and the dispensing request that were inputted, and determining that the valuable medium can be dispensed, performs dispensing of the valuable medium.

According to still another aspect of the present invention, the control unit causes the valuable-medium processing unit to process the valuable medium on the specific no-processing day when the specific no-processing day was selected by the input unit from the information pertaining to the no-processing days displayed on the display unit.

According to still another aspect of the present invention, the control unit exerts control on the valuable-medium processing unit to dispense the valuable medium when the information pertaining to the error stored in the storage unit is less than or equal to the predetermined threshold value.

According to still another aspect of the present invention, the information pertaining to the cash register includes identification information and operator information of the cash register.

According to still another aspect of the present invention, a method of processing the valuable medium is provided that includes storing the information pertaining to the processing of the valuable medium, displaying on a predetermined display unit the information pertaining to the no-processing day on which the valuable medium stored at the storing has not been processed, and processing the valuable medium as a processing for the specific no-processing day when the specific no-processing day displayed on the display unit was inputted by using the input unit that is used for inputting the information pertaining to the processing of the valuable medium.

Advantages of the Invention

According to an aspect of the present invention, a valuable-medium processing apparatus is provided that includes a valuable-medium processing unit that processes valuable medium, a storage unit that stores therein information pertaining to processing of the valuable medium, a display unit that displays the information pertaining to the processing of the valuable medium, an input unit for inputting the information pertaining to the processing of the valuable medium, a display control unit that causes the display unit to display information pertaining to a no-processing day on which the valuable medium was not processed by the valuable-medium processing unit, and a control unit that causes the valuable-medium processing unit to process the valuable medium on a specific no-processing day when the specific no-processing day displayed on the display unit was inputted using the input unit. Therefore, the complexity of a task when a user, such as a teller, processes the valuable medium, such as sales proceeds, of a plurality of days, on a sales day basis, all at once at a later date or when a cash dispensing process of a plurality of the days is performed all at once is reduced.

According to another aspect of the present invention, the control unit causes the storage unit to store therein the no-processing day that was inputted and processing results of the valuable medium processed by the valuable-medium processing unit in an associated form. Therefore, the processing results and processing days can be easily managed when the user, such as the teller, processes the valuable medium, such as the sales proceeds, of the plurality of days, on a sales day basis, all at once at a later date or when the cash dispensing process of the plurality of days is performed all at once.

According to still another aspect of the present invention, the valuable-medium processing unit counts and processes a numerical quantity and a kind of the valuable medium collected from a cash register. Therefore, the complexity of the task when the user, such as the teller, performs a counting process of the valuable medium, such as the sales proceeds, of the plurality of days, on a sales day basis, all at once at a later date is reduced.

According to still another aspect of the present invention, the valuable-medium processing unit counts and processes a total amount or a total value of the valuable medium collected from the cash register. Therefore, the complexity of the task when the user, such as the teller, performs the counting process of the valuable medium, such as the sales proceeds, of the plurality of days, on a sales day basis, all at once at a later date is reduced.

According to still another aspect of the present invention, the valuable-medium processing apparatus includes a numerical-quantity receiving unit that receives the numerical quantity and the kind of the valuable medium, an information receiving unit that receives the information pertaining to the cash register, and an error detecting unit that detects an error by comparing a counting result obtained by the valuable-medium processing unit and the numerical quantity and the kind of the valuable medium received by the numerical-quantity receiving unit, and when the error was detected by the error detecting unit, the control unit causes the storage unit to store therein the information pertaining to the error and the information pertaining to the cash register of which the error was detected. Therefore, the complexity of the task when the user, such as the teller, processes the valuable medium, such as the sales proceeds, of the plurality of days, on a sales day basis, all at once at a later date is reduced. When performing counting of the valuable medium at a later date, the information of the error pertaining to the counting result of the numerical quantity and the denomination of the valuable medium, and the information pertaining to the cash register of which the error is detected can be easily managed.

According to still another aspect of the present invention, the valuable-medium processing apparatus includes a value receiving unit that receives the total amount or the total value of the valuable medium, an information receiving unit that receives the information pertaining to the cash register, and an error detecting unit that detects the error by comparing the counting result obtained by the valuable-medium processing unit and the total amount or the total value of the valuable medium received by the value receiving unit, and when the error was detected by the error detecting unit, the control unit causes the storage unit to store therein the information pertaining to the error and the information pertaining to the cash register of which the error was detected. Therefore, the complexity of the task when the user, such as the teller, processes the valuable medium, such as the sales proceeds, of the plurality of days, on a sales day basis, all at once at a later date is reduced. When performing counting of the valuable medium at a later date, the information of the error pertaining to the counting result of the total amount or the total value of the valuable medium and the information pertaining to the cash register of which the error is detected can be easily managed.

According to still another aspect of the present invention, the display control unit causes the display unit to display the information pertaining to the error and the information pertaining to the cash register of which the error was detected, stored in the storage unit. Therefore, the cash register of which the error has occurred during counting can be easily identified.

According to still another aspect of the present invention, the display control unit causes the display unit to display the information including an error that exceeds a predetermined threshold value and the information pertaining to the cash register of which the error was detected, stored in the storage unit. Therefore, the cash register of which the error that has exceeded the predetermined threshold value has occurred during counting can be easily identified.

According to still another aspect of the present invention, the valuable-medium processing unit includes a recognition unit that recognizes a deposited valuable medium, and a valuable-medium storage unit that stores therein the valuable medium recognized by the recognition unit. Therefore, the valuable medium, such as the sales proceeds of the plurality of days can be stored in the valuable-medium storage unit.

According to still another aspect of the present invention, the valuable-medium processing apparatus includes the valuable-medium processing unit that dispenses the valuable medium, and a dispensing requesting unit that issues a dispensing request to the control unit for dispensing of the valuable medium, and the control unit, upon receiving the no-processing day and the dispensing request that were inputted, and determining that the valuable medium can be dispensed, performs dispensing of the valuable medium. Therefore, the complexity of the task while performing cash dispensing of the plurality of days is reduced.

According to still another aspect of the present invention, the control unit causes the valuable-medium processing unit to process the valuable medium on a specific no-processing day when the specific no-processing day was selected from the information pertaining to the no-processing days displayed on the display unit using the input unit. Therefore, time and effort required for inputting the no-processing days can be saved. Furthermore, the valuable medium of the selected day can be processed merely by selecting the no-processing day from the displayed no-processing days.

According to still another aspect of the present invention, the control unit exerts control on the valuable-medium processing unit to dispense the valuable medium when the information pertaining to the error stored in the storage unit is less than or equal to the predetermined threshold value. Therefore, the valuable medium is not dispensed to the cash register of which the error in the counting result exceeds the predetermined threshold value.

According to still another aspect of the present invention, the information pertaining to the cash register includes identification information and operator information of the cash register. Therefore, the cash register of which the error has occurred during counting and an operator of the cash register can be easily managed.

BRIEF DESCRIPTION OF DRAWINGS

FIG. 3 is a process history table for a certain month, pertaining to a cash register 1 that is assigned an identification information No. 01 and a cashier with an operator ID 0101.

EXPLANATIONS OF LETTERS OR NUMERALS

Figure 1:
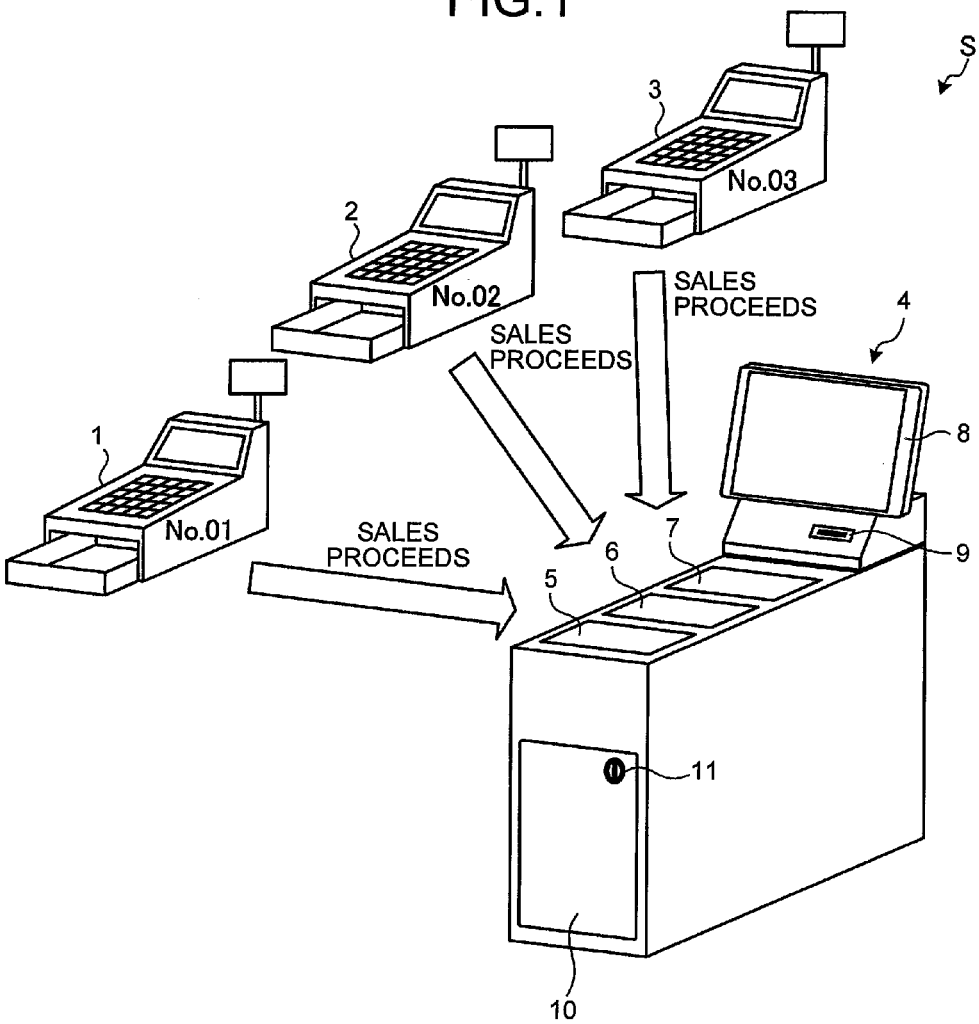
FIG. 1 is a drawing of a valuable-medium processing system according to an embodiment of the present invention.

S: Valuable-medium processing system
1 to 3: Cash register
4: Cash recycler
5: Inlet unit
6: Outlet unit
7: Reject unit
8: Display and operating unit
9: Card reader unit
21: Main control unit
22: Display control unit
23: Counting unit
24: Error-amount detecting unit
25: Process-history storage unit
26: Recognition unit
27: Transport control unit
28: Transport mechanism
29: Denomination-wise storage unit
30: Cash-dispensing processing unit

BEST MODE(S) FOR CARRYING OUT THE INVENTION

Exemplary embodiments of a valuable-medium processing apparatus according to the present invention are explained below in detail with reference to the accompanying drawings. In the explanation below, a case in which the present invention is applied to a valuable-medium processing system, that includes a plurality of cash registers installed in stores and a cash recycler that is installed in a back office of stores and performs management of sales proceeds collected from the cash registers, is presented as an example. However, the present invention can also be applied to a valuable-medium processing apparatus that handles valuable medium other than currency, such as gift vouchers and coupons. The present invention can also be applied to valuable-medium processing apparatus that only accepts deposits or only dispenses currency, or that accepts deposits as well as disburses cash.

FIG. 1 is a drawing of the valuable-medium processing system according to an embodiment of the present invention. As shown in FIG. 1, a valuable-medium processing system S according to the present embodiment includes a plurality of (three, in this example) cash registers 1 to 3 installed in stores, and a cash recycler 4 that is installed in a back office of a retail store and performs management of sales proceeds collected from the cash registers 1 to 3.

Each of the cash registers 1 to 3 performs an payment process of merchandise prices paid by customers, and have a structure similar to a conventional cash register; hence, a detailed explanation thereof is omitted. The apparatus from which valuable medium is collected is not to be limited to the cash registers 1 to 3. Other devices, such as a terminal device with a drawer provided at a shop window of the retail store, can also be used as a source from which valuable medium such as cash can be collected and processed by the cash recycler 4 according to the present embodiment.

Each of the cash registers 1 to 3 is assigned unique identification information for distinguishing them from each other. In the present embodiment, the cash register 1 is assigned No. 01 as identification information, the cash register 2 is assigned No. 02, and the cash register 3 is assigned No. 03.

Each of the cash registers 1 to 3 is operated by an operator (hereinafter, "cashier"), and each of the cashiers is also assigned unique operator identification information (hereinafter, "operator ID") for distinguishing them from each other.

In the present embodiment, the cashier operating the cash register 1 is assigned an operator ID 0101, the cashier operating the cash register 2 is assigned an operator ID 0102, and the cashier operating the cash register 3 is assigned an operator ID 0103.

At the end of the day's business, each cashier operates their cash registers 1 to 3 and prints a receipt of the sales proceeds that were processed in the day, collects the sales proceeds for the day from the cash registers 1 to 3 and takes it to the back office at the back of the store where the cash recycler 4 is installed, and keeps the sales proceeds in designated safes in the back office. From safety angle, the sales proceeds can be also collected during business hours (midway collection). The collected sales proceeds are also kept in the safes.

The cash recycler 4 is operated by a dedicated operator (hereinafter, "teller") who is different from the cashiers. The cash recycler 4 is a device that, when the sales proceeds are deposited, performs management of the sales proceeds by counting the sales proceeds on a business day (sales day) basis for each of the cash registers 1 to 3, and storing therein a processing result thereof. Furthermore, the cash recycler 4 also performs a cash dispensing process of a change fund to be used by the cash registers 1 to 3 on and after the following day.

The cash recycler 4 includes, on a top surface of a housing thereof, a inlet unit 5 where cash such as the sales proceeds is deposited, an outlet unit 6 that dispenses cash such as the change fund, and a reject unit 7 that returns paper sheets, such as unrecognized paper, soiled banknote or counterfeit banknote, that cannot be handled on the cash recycler 4.

The cash recycler 4 includes, above the housing, a touch-panel type display and operating unit 8 that displays various infographics such as operation procedures and processing results of the cash recycler 4, and various processes pertaining to the sales proceeds are executed according to the position where the teller touches on the screen of the touch panel. A card reader unit 9 is provided below the display and operating unit 8. The card reader unit 9 reads designated information from an ID card, which is issued only to a specific individual, when the ID card is inserted. The reference numeral 10 in FIG. 1 denotes a door that is opened and closed when collecting the currency and when replenishing the currency in the cash recycler 4. The reference numeral 11 denotes a keyhole for locking and unlocking the door 10.

Figure 2:
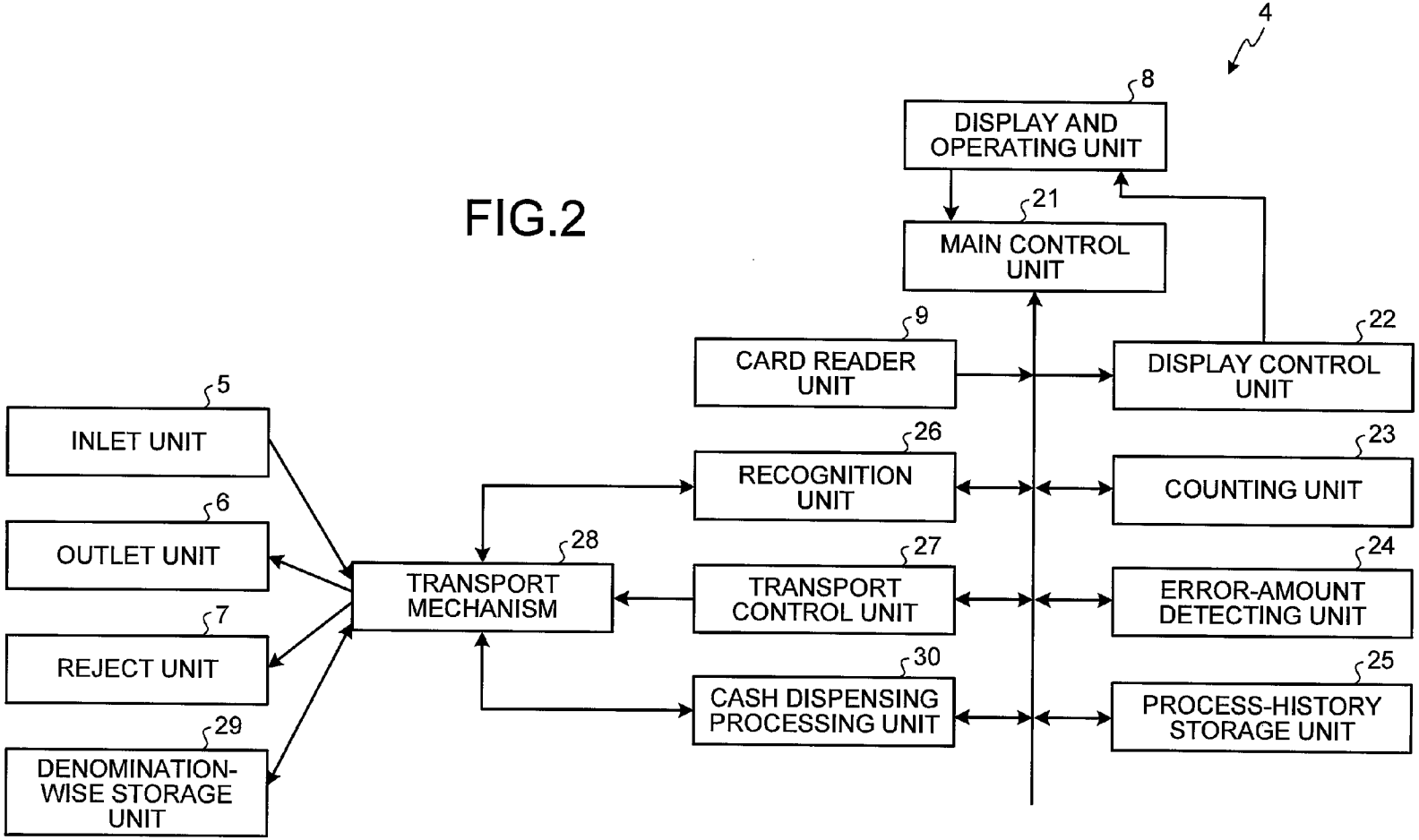
FIG. 2 is a functional block diagram of a cash recycler according to the present embodiment.

A main control unit, etc., that executes various processes pertaining to the deposited currency is inside the housing of the cash recycler 4. A concrete structure of the cash recycler 4 is explained with reference to FIG. 2. FIG. 2 is a functional block diagram of the cash recycler 4 according to the present embodiment.

As shown in FIG. 2, the cash recycler 4 includes a main control unit 21 that performs an overall control of operations of the cash recycler 4, a display control unit 22, a counting unit 23, an error-amount detecting unit 24, a recognition unit 26, a transport control unit 27, and a dispensing processing unit 30. An operation of each of these units is controlled by the main control unit 21. All the units are interconnected with a bus used for communication.

The cash recycler 4 further includes the display and operating unit 8, the card reader unit 9, the inlet unit 5, the outlet unit 6, the reject unit 7, and a denomination-wise storage unit 29 that store currency, deposited as the sales proceeds, by denomination. The inlet unit 5, the outlet unit 6, the reject unit 7, the denomination-wise storage unit 29, the recognition unit 26, and the cash-dispensing processing unit 30 are connected to the transport control unit 27 via a transport mechanism 28. The cash recycler 4 further includes a process-history storage unit 25 that stores therein process history information pertaining to a history of processes related to the sales proceeds, and dispensing history information of the change fund.

The main control unit 21 includes a CPU (Central Processing Unit), a ROM (Read-Only Memory), and a RAM (Random Access Memory), and exerts control on the operations of the display control unit 22, the counting unit 23, the error-amount detecting unit 24, the recognition unit 26, the transport control unit 27, and the cash-dispensing processing unit 30 when the CPU reads and executes a suitable program from among various programs stored in the ROM based on an operation signal input via the display and operating unit 8. In addition, the main control unit 21 updates the process history information stored in the process-history storage unit 25 and controls the operations of the cash recycler 4. The RAM serves as a temporary storage area used by the CPU as a working area when the CPU executes the various programs stored in the ROM.

The display control unit 22 operates according to the control exerted by the main control unit 21, and suitably displays, on the display and operating unit 8, various infographics such as operation procedures and processing results of the cash recycler 4. During the dispensing of the change fund, the display control unit 22 displays a screen for the teller to select a combination pattern of denominations and numerical quantities of the currency to be dispensed. In the present embodiment, the display control unit 22 and the main control unit 21 are different entities; however, a display control function of the display control unit 22 can be integrated into the main control unit 21.

The recognition unit 26 operates according to the control exerted by the main control unit 21, and captures an image of each currency placed in the inlet unit 5, and recognizes such as the authenticity, fitness, and denomination of the currency.

The paper sheets judged to be soiled or counterfeit by the recognition unit 26 are returned through the reject unit 7 to out of the apparatus.

The counting unit 23 operates according to the control exerted by the main control unit 21, and counts the numerical quantity and the denominations of the currency, that have been recognized by the recognition unit 26 as genuine note and not unfit and counterfeit note, for each of the cash registers 1 to 3. Although in the present embodiment the counting unit 23 has been configured to count the numerical quantity and the denominations of the currency, the counting unit 23 can also be configured to count, for each of the cash registers 1 to 3, a total amount or a total value of cash and other valuable mediums such as gift vouchers and coupons.

The error-amount detecting unit 24 operates according to the control exerted by the main control unit 21, and detects an error amount between a deposit amount inputted by the teller through the display and operating unit 8 at the time of depositing the currency into the cash recycler 4 and a counting result of the currency by the counting unit 23. The deposit amount inputted by the teller is a sales amount for each of the cash registers 1 to 3 for the date printed on the receipt issued by each of the cash registers 1 to 3 at the end of the day's business.

Although a case in which the teller inputs the amount of cash being deposited is presented as an example here, the teller can also input the total amount or the total value for each type of the valuable medium such as kind of currency, the denomination, or kind of the coupons and the gift vouchers. When inputting the total amount or the total value of the valuable medium, the error-amount detecting unit 24 detects an error amount between the inputted total amount or the total value of the valuable medium and the counting result by the counting unit 23.

In the cash recycler according to the present embodiment, the teller uses the display and operating unit 8 to manually input the information about the sales amount, etc. However, a structure for inputting the sales amount is not to be thus limited. For example, the cash recycler 4 and the cash registers 1 to 3 can be connected via a predetermined communication network, and the information about the day's sales amount (number of currency of each denomination, the total amount of currency, or the total value, etc.) can be sent from each of the cash registers 1 to 3 to the cash recycler 4. Alternatively, a barcode reader can be provided in the cash recycler 4, and the information about the day's sales amount, etc., can be input into the cash recycler 4 by using a barcode on which the sales amount is recorded. Yet another way is to provide the cash recycler 4 with an interface to which an electronic storage medium can be connected, and the information about the day's sales amount is inputted by using the electronic storage medium on which the sales amount is recorded.

The display and operating unit 8, as mentioned above, displays the infographics such as the operation procedures and the processing results of the cash recycler 4, and serves as a touch-panel type display device. Various processes pertaining to the sales proceeds are executed according to the position, where the teller touches, on the screen.

When the teller touches a predetermined position on the screen of the display and operating unit 8 to perform an operation, the display and operating unit 8 sends to the main control unit 21 an operation signal according to the operation. Upon receiving the operation signal, the main control unit 21 outputs, according to the operation signal, a predetermined control signal for each of the display control unit 22, the recognition unit 26, the counting unit 23, the error-amount detecting unit 24, the transport control unit 27, and the cash-dispensing processing unit 30.

The card reader unit 9 reads from the ID card, which is issued only to an individual such as a manager or a supervisor of the retail store, to whom specific powers are granted, information that identifies the owner of the ID card when the ID card is inserted, and outputs the information to the main control unit 21. Upon receiving the information from the card reader unit 9, the main control unit 21 exerts control on the operation of the display control unit 22 so that all the process history information is displayed on the display and operating unit 8. That is, in the cash recycler 4 according to the present embodiment, all the process history information stored in the process-history storage unit 25 is displayed on the display and operating unit 8 by inserting the ID card.

In the cash recycler 4 according to the present embodiment, the individual to whom specific powers are granted is identified from the ID card. However, a structure for identification of the individual with specific powers is not to be thus limited and other structures can be used for the identification. For example, the cash recycler 4 can have a biometrics function and pre-stored biometrics information (such as face image, fingerprint information, vein information, retina information, etc.) of an individual to whom specific powers are granted, and the individual can be identified based on the biometrics information. Alternatively, a barcode or an electronic storage medium on which information unique to the specific individual is stored can be used in the cash recycler 4 to identify the individual.

The transport control unit 27 is operated according to the control exerted by the main control unit 21, and it controls the transport mechanism 28. The transport mechanism 28 is configured to enable two-way transport of the currency between the inlet unit 5, the outlet unit 6, the reject unit 7, the recognition unit 26, and the denomination-wise storage unit 29.

The denomination-wise storage unit 29 includes a plurality of stackers for temporarily keeping currency by denomination. Once the denomination of the currency is determined by the recognition unit 26, it is sorted and stored in the designated stacker based on the denomination. During the dispensing of the change fund, the currency is transported by the transport mechanism 28 from the denomination-wise storage unit 29 to the outlet unit 6.

The process-history storage unit 25 is a non-volatile memory such as a high-capacity flash memory, and stores therein a date of a processing day on which the counting process of the currency was performed by the counting unit 23, the counting result of the currency subjected to the counting process by the counting unit 23 on the processing day, and the error amount between the counting result and the input amount inputted by the teller in an associated form as the process history information. The process-history storage unit 25 also stores therein a process history table for each of the cash registers 1 to 3. In the process history table, the process history information is categorized by the cashiers and by the cash registers 1 to 3 from which currency has been collected after the counting process.

In addition to the history information pertaining to the counting process, the process-history storage unit 25 also stores therein the process history information pertaining to the cash dispensing process. The process history information pertaining to the cash dispensing process is also categorized by the cash registers 1 to 3 as well as by the cashiers, and is stored with the processing day corresponding to the cash dispensing process and the processing result of the cash dispensing process in an associated form. The processing day corresponding to the cash dispensing process here does not indicate the day on which the cash dispensing process is performed, but the scheduled day on which the dispensed currency will be used as the change fund by each of the cash registers 1 to 3.

The process-history storage unit 25 stores therein, in an associated form, a date of a no-processing day and a date of actual processing of what ought to have been processed on the no-processing day, pertaining to the counting process and the cash dispensing process.

The process history table stored in the process-history storage unit 25 is explained in greater detail with reference to FIG. 3. FIG. 3 is a process history table for a certain month, pertaining to the cash register 1 that is assigned the identification information No. 01 and the cashier with the operator ID 0101.

As shown in FIG. 3, the process history table pertaining to the cash register 1 stored by the process-history storage unit 25 contains, in an associated form, the processing date on which the counting process of the counting unit 23 was performed, the error amount detected by the error-amount detecting unit 24 based on the counting result, a cumulative frequency when the error amount has exceeded a predetermined threshold value, a deposit completion flag that indicates whether the currency collected from the cash register 1 has been deposited into the cash recycler 4 on the processing day when the counting process is ought to have been performed by the counting unit 23, and an alarm flag that indicates whether the cumulative frequency has reached a predetermined value (prescribed value: 3 in this example). Though not shown in FIG. 3, the process history table also stores therein a dispensing flag that indicates whether a cash dispensing process has been performed by the cash recycler 4 on a day on which the cash dispensing process ought to have been performed.

It can be understood from the process history table of FIG. 3 that the cash register 1 has performed the counting process on 1st, 2nd, 3rd, and 5th and not on 4th of the concerned month. Therefore, the deposit completion flag corresponding to 1st, 2nd, 3rd, and 5th is set to "1", indicating a processed (deposited) state, and the deposited flag corresponding to 4th is set to "0", indicating an unprocessed (not deposited) state.

Furthermore, based on a numerical value corresponding to the cumulative frequency in the process history table, it can also be understood that the error amount detected on 2nd, 3rd, and 5th have exceeded the predetermined error amount, and that on 5th the cumulative frequency, when the error amount detected by the error-amount detecting unit 24 has exceeded the predetermined error amount, has reached the prescribed value that is 3. Consequently, in the cash recycler 4, when the cumulative frequency, when the error amount exceeds the predetermined error amount, reaches the prescribed value that is 3, it is determined that the error amount stored in the process history table in the cash register 1 has exceeded the predetermined threshold value, and therefore the alarm flag is set to "1", which indicates an alarm display described later.

The error amount is an absolute value of the error amount between the sales amount manually inputted by the teller and a count amount obtained as a result of the counting process, and includes both a plus error and a minus error relative to the sales amount manually inputted by the teller.

In the cash recycler 4 according to the present embodiment, when the cumulative frequency when the error amount exceeds the predetermined threshold value reaches 3, the alarm flag is set to "1". However, the alarm flag can be set to "1" based on other criteria. For example, the alarm flag can be set to "1" when the error amount exceeds the predetermined threshold value in a unit time period. In this case, the alarm flag can be set to "1" when the error amount divided by an operation time of the cash register exceeds the predetermined threshold value. Alternatively, the error amount can be judged to have exceeded the predetermined threshold value when a cumulative total of an absolute error value exceeds the predetermined threshold value in a given time period, and therefore the alarm flag can be set to "1".

In the cash recycler 4 according to the present embodiment, the process history table described above is stored in the process-history storage unit 25 for each of the cash registers 1 to 3 as well as for each of the cashiers. Thus, in the present embodiment, the process-history storage unit 25 functions as a storage unit that stores therein, for each of the cash registers from which the valuable medium has been collected, the processing day on which the valuable medium is processed by a valuable-medium processing unit and the processing result of the valuable medium on the processing day.

A flow of a sequence of operations performed by the teller using the cash recycler 4 for counting the currency is explained with reference to FIGS. 4A to 4I. FIGS. 4A to 4I are examples of contents displayed on the display and operating unit 8 when the teller performs a counting operation.

A concept of the no-processing day that appears in the subsequent section is explained first before explaining the flow of the sequence of operations performed by the teller when performing the counting of the currency. The term "no-processing day" refers to a day on which no processing has been performed in a predetermined period that is set beforehand.

More specifically, a no-processing day pertaining to a sales proceeds deposit process refers to the current day or a previous day on which no sales proceeds deposit has taken place yet. A no-processing day is normally either the current day or a past day. However, when an opening process of a cash register (the process of registering the cash register to be operated on a given business day) is not finished, that day is not displayed on a display unit as a candidate for no-processing day. An alarm can be displayed if an attempt is made to deposit the sales proceeds of the day that is not displayed on the display unit.

Furthermore, in the present embodiment, a no-processing day pertaining to the dispensing of the change fund refers to the current day or any following day for which dispensing of the change fund has not been performed yet. Thus, a no-processing day in this case is normally the current day or a future day.

Furthermore, in the present embodiment, during the dispensing of the change fund, the change fund that has not been dispensed within a predetermined set period for the cash register can be dispensed. For example, if the predetermined set period is three days, the cash register, for which the change fund has not been dispensed within three days from the current day, is displayed on the display unit.

When dispensing the change fund, a dispensing restriction can be enforced based on the change fund that has already been dispensed or the number of dispenses. For example, the cash recycler 4 can be configured such that a limit can be set on an amount or the number of times the change fund can be dispensed for one cash register in one day, and all requests for dispensing of the change fund exceeding the limit can be denied by the cash recycler 4. Similarly, the amount or the number of times, that the change fund can be dispensed for one cash register for the cumulative total of the no-processing days (for example, three days) pertaining to the cash dispensing process of the change fund, can be limited.

Furthermore, the dispensing restriction of the change fund can also be enforced based on whether the opening process of the cash register is finished. For example, the cash recycler 4 can be configured to deny dispensing process of the change fund for the cash register of which the opening process is not finished. Alternatively, the cash recycler 4 can be configured to dispense the change fund even if the opening process is not finished.

Figure 4A:
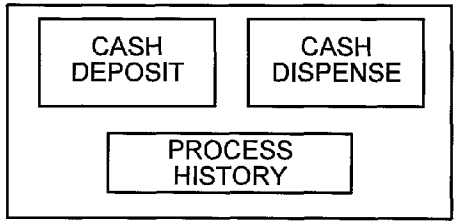
FIGS. 4A to 4I are examples of graphics displayed on a display and operating unit when a teller performs a counting operation.

In the cash recycler 4 according to the present embodiment, in a standby mode as shown in FIG. 4A, the display and operating unit 8 displays options "Cash Deposit", "Cash Dispense", and "Process History" so that a user, that is the teller, can select one of a cash deposit process, a cash dispensing process, and a process history display process to be executed by the cash recycler 4.

Figure 4B:
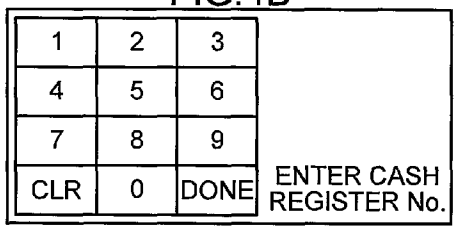

When the teller touches the option "Cash Deposit" on the screen to perform a cash deposit operation, the cash recycler 4 displays, on the display and operating unit 8, a prompt "Enter cash register No." with an infographic prompting the teller to enter the identification information of the cash registers 1 to 3, as shown in FIG. 4B.

Figure 4C:
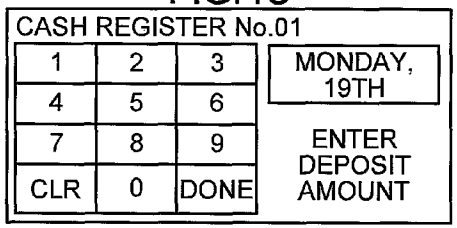

Assuming that the teller enters "01", which is the identification information of the cash register 1, using a numerical keypad displayed on the screen, and confirms it by touching the option "Done". If there are no no-processing days on which counting of the sales proceeds has not been done for the cash register 1, the cash recycler 4 displays the current day's (Monday, the 19th) cash deposit infographic on the display and operating unit 8, as shown in FIG. 4C. The cash recycler 4 in the present embodiment is configured to prompt the teller to enter the identification information of the cash register from which the sales proceeds have been collected (the cash register 1 in the present embodiment) and whose sales proceeds are to be deposited. However, the cash recycler 4 can also be configured to prompt the input of the operator ID of the cashier who collected the sales proceeds from the cash register 1.

When the teller enters the deposit amount to be deposited using the numerical keypad present in the cash deposit infographic (FIG. 4C), deposits the sales proceeds of the 19th collected from the cash register 1 into the cash recycler 4, and touches the option "Done", the cash recycler 4 performs a recognition process, the counting process, and an error-amount detection process on the currency that has been deposited.

Figure 4D:
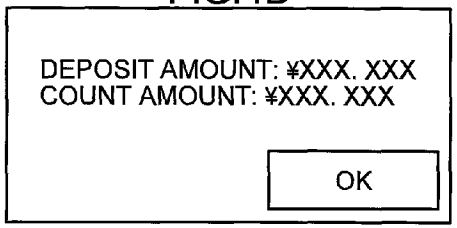

If, based on a result of the processes mentioned above, no error is found in the deposit amount and the count amount, the cash recycler 4 displays the deposit amount and the count amount, as shown in FIG. 4D. The case when an error is found will be explained later. Thereafter, when the teller touches the option "OK" on the screen, the cash recycler 4 stores the current counting result in the process history table pertaining to the cash register 1.

If there is a plurality of no-processing days on which no counting has been done but counting of the sales proceeds ought to have been done for those days for the cash register 1, for example, due to the absence of the teller on Saturday, the 17th and Sunday, the 18th, counting of the sales proceeds has to be done for three days, that is from 17th to 19th, all at once on a sales day basis on Monday, the 19th when the teller reports for work. The cash recycler 4 displays on the display and operating unit 8 the infographic prompting the teller to select the processing day from among 17th to 19th, as shown in FIG. 4E.

Thus, in the cash recycler 4 according to the present embodiment, if there is a plurality of no-processing days, information pertaining to the no-processing days when no counting process has been done is displayed on a single screen. Consequently, the teller can easily confirm that there is a plurality of no-processing days without confirming the receipts issued by the cash registers 1 to 3. Thus, the workload of the teller is reduced.

Figure 4E:
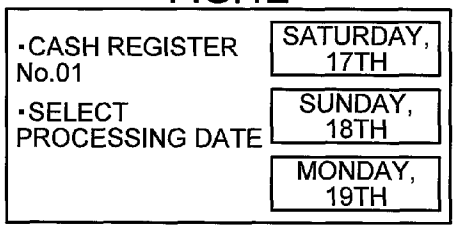
Figure 4F:
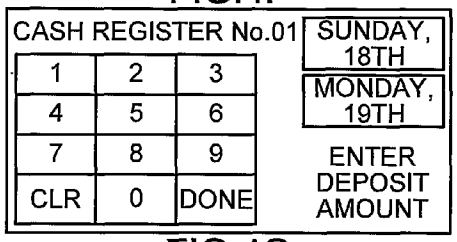

When the teller touches the option "Saturday, the 17th" on the screen shown in FIG. 4E, the cash recycler 4, displays the cash deposit infographic of Saturday, the 17th on the display and operating unit 8 which no longer includes the option "Saturday, the 17th", as shown in FIG. 4F.

When the teller enters the deposit amount to be deposited using the numerical keypad on the screen shown in FIG. 4F, deposits the sales proceeds of the 17th collected from the cash register 1 into the cash recycler 4, and touches the option "Done", the cash recycler 4 performs the recognition process, the counting process, and the error-amount detection process on the currency that has been deposited.

If, based on the result of the processes mentioned above, no error is found in the deposit amount and the count amount, the cash recycler 4 displays the deposit amount and the count amount, identical to what is shown in FIG. 4D. Thereafter, when the teller touches the option "OK" on the screen, the cash recycler 4 stores the current counting result in the process history table pertaining to the cash register 1. Thus, the counting process for the sales proceeds for Saturday, the 17th, which was a no-processing day, is completed.

Figure 4G:
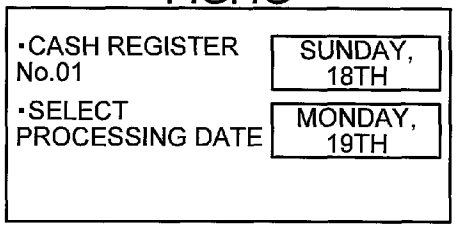

Thereafter, the cash recycler 4 displays on the display and operating unit 8 the infographic shown in FIG. 4G which includes the remaining no-processing days ("Sunday, the 18th" and "Monday, the 19th") and a prompt for the teller "Select processing date".

When the teller selects either the option "Sunday, the 18th" or the option "Monday, the 19th" from the infographic shown in FIG. 4G, the cash recycler 4 performs the counting process continuously for the sales proceeds for the selected date.

Thus, in the cash recycler 4 according to the present embodiment, the user, that is the teller, merely has to select the no-processing day from among a plurality of the no-processing days displayed on the display and operating unit 8 to perform the counting process of the sales proceeds for the concerned no-processing day. Because there is no need to change a processing date setting of the cash recycler 4 for the no-processing days, the complexity of the task is reduced when performing the counting process of the sales proceeds of a plurality of days all at once, on a sales day basis.

Figure 4H:
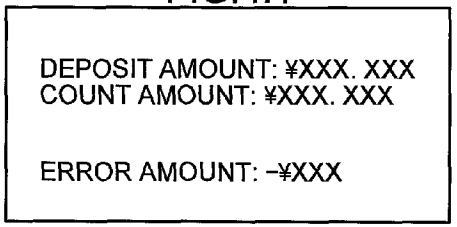

If, based on a result of the error-amount detection process, an error is found between the deposit amount and the count amount, the cash recycler 4 according to the present embodiment displays the deposit amount and the count amount, as shown in FIG. 4H, and also displays the error amount detected by the error-amount detecting unit 24. When the teller touches the option "OK" on the screen, the cash recycler 4 stores the current counting result in the process history table pertaining to the cash register 1.

Figure 4I:
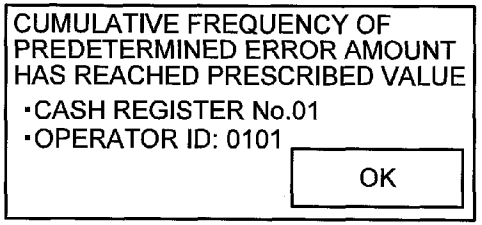

If the error amount detected by the error-amount detecting unit 24 exceeds the predetermined error amount, the cash recycler 4 adds 1 to the cumulative frequency in the process history table pertaining to the cash register 1, and if the cumulative frequency reaches 3, which is the prescribed value, the identification information (No. 01) and the cash register operator ID (0101) of the cash register 1 are displayed as the alarm display, as shown in FIG. 4I.

In the present embodiment, if the error amount detected by the error-amount detecting unit 24 exceeds the predetermined error amount, the identification information (No. 01) and the operator ID (0101) of the cash register 1 are displayed as the alarm display, as shown in FIG. 4I. However, an alarm output method is not to be thus limited.

As one of other output methods, for example, the cash recycler 4 can be provided with a printer that can print the alarm display shown in FIG. 4I and the alarm display can be in the form of a print output. Alternatively, the cash recycler 4 can be provided with a communication unit that can send information to a mobile terminal or any other terminal by wired or wireless communication, and the identification information and the operator ID of the cash register whose error amount has exceeded the predetermined error amount can be sent to the mobile terminal or the other terminal as an external output. In this structure, the information in the process history table can also be sent to the mobile terminal or the other terminal as an external output, irrespective of the error amount of the detected error amount.

Thus, the cash recycler 4 according to the present embodiment allows cash deposit to be performed if the error between the deposit amount and the count amount is less than or equal to the predetermined threshold value. If the error, between the deposit amount and the count amount, exceeding the predetermined threshold value occurs frequently, the cash recycler 4 displays the alarm indicating identification information of the cash register and the operator ID to identify the cashier of the cash register. Consequently, the teller can easily find out a frequency of error occurrence of the cash register, or a fraudulent activity of the cashier.

Figure 5:
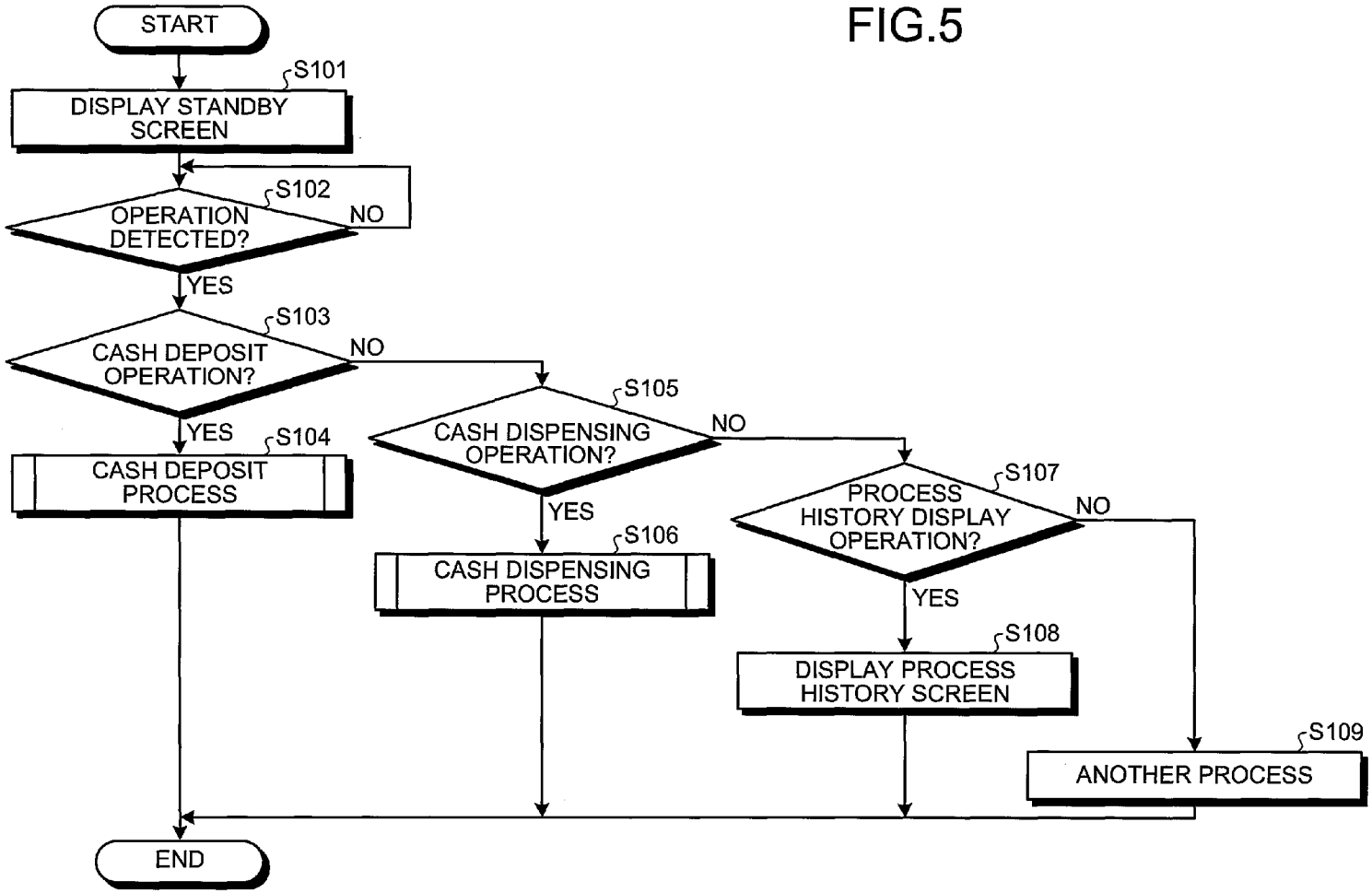
FIG. 5 is a flowchart of processes executed by the cash recycler according to the present embodiment.
Figure 6:
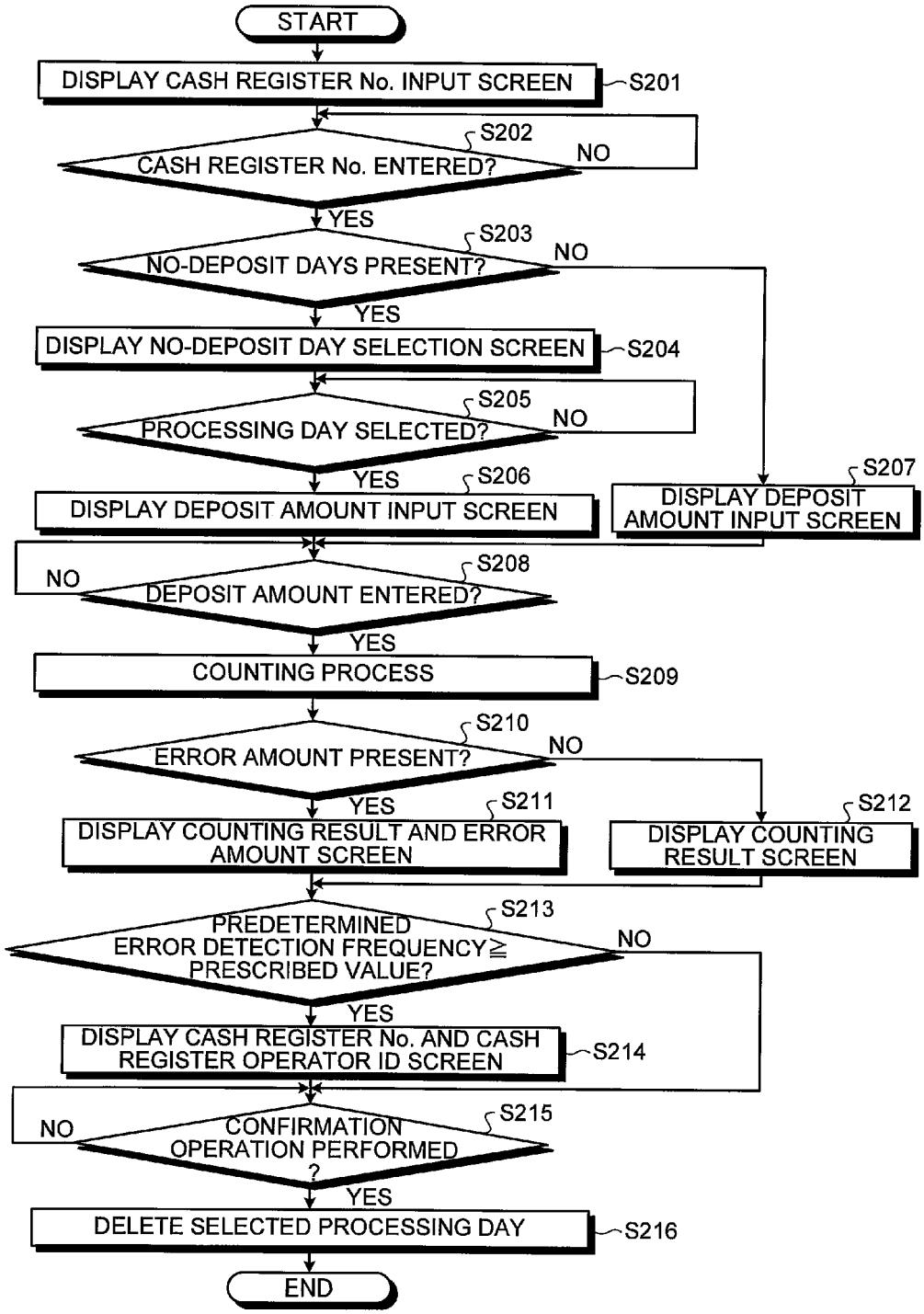
FIG. 6 is a flowchart of a process executed by the cash recycler according to the present embodiment.

The processes executed by the cash recycler 4 when the teller performs the counting operation of the sales proceeds described above are explained with reference to FIGS. 5 and 6. FIGS. 5 and 6 are flowcharts of the processes executed by the cash recycler 4.

During the power of the cash recycler 4 according to the present embodiment is on, the cash recycler 4 repeatedly performs the various processes shown in the flowchart in FIG. 5. As shown in FIG. 5, when the cash recycler 4 is powered on, the main control unit 21 exerts control on the operation of the display control unit 22 to display a standby screen (see FIG. 4A) on the display and operating unit 8 (Step S101).

Next, the main control unit 21 determines whether there has been an operation of the display and operating unit 8 (Step S102), and if so (Yes at Step S102), advances the process to Step S103, otherwise (No at Step S102), Step S102 is executed repeatedly. At Step S102, the main control unit 21 determines that there has been an operation of the display and operating unit 8 when it receives a predetermined operation signal from the display and operating unit 8.

Based on the operation signal received from the display and operating unit 8, the main control unit 21 determines whether the operation detected at Step S102 is a cash deposit operation (Step S103), and if so (Yes at Step S103), advances the process to Step S104, where the cash deposit process, in which the currencies collected from the cash registers 1 to 3 are taken inside and counted, is executed, and thereafter ends the process. The cash deposit process is explained in detail later with reference to FIG. 6.

If the main control unit 21 determines that the operation detected at Step S102 is not a cash deposit operation (No at Step S103), the main control unit 21 determines whether the operation is a cash dispensing operation (Step S105).

If it is determined that the operation detected at Step S102 is a cash dispensing operation (Yes at Step S105), the main control unit 21 executes the cash dispensing process in which the currency in an amount and denominations as per the operation is dispensed to the outside (Step S106), and ends the process. The cash dispensing process is explained later. If it is determined that the operation detected at Step S102 is not a cash dispensing operation (No at Step S105), the main control unit 21 determines whether the operation at Step S102 was a process history display operation (Step S107).

If it is determined that the operation detected at Step S102 is a process history display operation (Yes at Step S107), the main control unit 21 exerts control on the operation of the display control unit 22 to display a process history screen on the display and operating unit 8 (Step S108). If the main control unit 21 receives the information concerning the predetermined ID card from the card reader unit 9, and the operation signal received from the display and operating unit 8 is a signal indicating the process history display operation, the main control unit 21 determines that the operation detected at Step S102 is a process history display operation. The display control unit 22 displays the process history tables concerning all the cash registers 1 to 3 on the display and operating unit 8.

If it is determined that the operation detected at Step S102 is not a process history display operation (No at Step S107), the main control unit 21 performs another process according to the operation that is detected at Step S102 (Step S109), and thereafter ends the process. Another process mentioned here can be, for example, a process for settings the initial setting of the cash recycler 4.

The cash deposit process performed at Step S104 is explained in detail with reference to FIG. 6. Once the cash deposit process is started, as shown in FIG. 6, the main control unit 21 exerts control on the display control unit 22 to display, on the display and operating unit 8, a cash register No. input screen (see FIG. 4B) that prompts input of the identification information (hereinafter, "cash register No.") of a specific cash register from among the cash registers 1 to 3 (Step S201).

Thereafter, the main control unit 21 determines whether a cash register No. has been entered (Step S202), and if no cash register No. has been entered (No at Step S202), repeats Step S202 until a cash register No. is entered, and once a cash register No. is entered (Yes at Step S202), advances the process to Step S203.

The teller enters the cash register No. using the numerical keypad displayed on the display and operating unit 8. That is, in the present embodiment, the display and operating unit 8 functions as an identification information input unit for inputting the identification information of the cash register. The cash register No. can also be inputted by using a cash register card, a barcode, an electronic medium, etc.

At Step S203, the main control unit 21 refers to the process history table pertaining to the cash register corresponding to the cash register No. inputted at Step S202, and determines whether there are days other than the current day on which the counting process of the sales proceeds has not been performed (no-deposit days) for the cash register. If there are no-deposit days other than the current day (Yes at Step S203), the process proceeds to Step S204, and otherwise (No at Step S203), the process proceeds to Step S207.

At Step S207, the main control unit 21 exerts control on the operation of the display control unit 22 to display, on the display and operating unit 8, a deposit amount input screen (see FIG. 4C) for entering the deposit amount of the current day, and thereafter advances the process to Step S208.

At Step S204, the main control unit 21 exerts control on the display control unit 22 to display, on the display and operating unit 8, a no-deposit day selection screen (see FIG. 4E) for selecting a no-deposit day, and thereafter advances the process to Step S205. If there is a plurality of no-deposit days, the display control unit 22 displays all the no-deposit days on the display and operating unit 8 as well as a prompt for selecting the processing day from among these no-deposit days for performing the counting process of the sales proceeds.

Thus, in the present embodiment, the display control unit 22 functions as a display control unit that exerts control to display, on a predetermined display unit, information pertaining to the no-processing days on which the valuable medium has not been processed by the valuable-medium processing unit.

Thereafter, at Step S205, the main control unit 21 determines whether a processing day has been selected, and if not (No at Step S205), repeats Step S205 until a processing day has been selected. If a processing day has been selected (Yes at Step S205), the main control unit 21 advances the process to Step S206.

The teller can select the desired processing day by using the no-deposit day selection screen displayed on the display and operating unit 8. Thus, in the present embodiment, the display and operating unit 8 functions as a processing day selecting unit for selecting a specific no-processing day from the information regarding the no-processing days displayed on the display unit.

At Step S206, the main control unit 21 causes the display and operating unit 8 to display a deposit amount input screen (see FIG. 4F) for entering the deposit amount of the processing day selected at Step S205, and thereafter advances the process to Step S208.

At Step S208, the main control unit 21 determines whether a deposit amount has been entered, and if no deposit amount has been entered (No at Step S208), repeats Step S208 until a deposit amount is entered. If a deposit amount has been entered (Yes at Step S208), the main control unit 21 advances the process to Step S209.

The teller can enter the sales proceeds printed on the receipts issued by the cash registers 1 to 3 from which the sales proceeds have been collected, or the cash amounts collected from the cash registers 1 to 3 to be deposited into the cash recycler 4 using the numerical keypad displayed on the deposit amount input screen displayed on the display and operating unit 8. Thus, in the present embodiment, the display and operating unit 8 functions as an amount input unit for entering the amount of the valuable medium to be subjected to the counting process by the valuable-medium processing unit. In the present embodiment, the sales amount is entered via the display and operating unit 8. However, instead of the amount, the number of currency of each denomination collected from the cash registers 1 to 3 can be entered.

Thereafter, when the currency is deposited into the cash recycler 4, the main control unit 21 performs the counting process of the deposited currency (Step S209). At Step S209, the main control unit 21 exerts control on the recognition unit 26 to perform the recognition process of the deposited currency, exerts control on the counting unit 23 to perform the counting process on the currency that has been subjected to the recognition process, exerts control on the error-amount detecting unit 24 to detect the error amount between the deposit amount inputted through the operation of the display and operating unit 8 and the count amount obtained as a result of the counting process, and thereafter advances the process to Step S210.

Thus, in the present embodiment, the error-amount detecting unit 24 functions as an error detecting unit that detects the error amount between the amount of the valuable medium inputted through the amount input unit and the counting result of the valuable medium counted by the valuable-medium processing unit after the selection of the no-processing day specified through the processing day selecting unit.

At Step S210, the main control unit 21 determines whether there is an error amount detected at Step S209. If there is the error amount (Yes at Step S210), the main control unit 21 increments the cumulative frequency in the process history table by 1, and advances the process to Step S211. If there is no error amounts (No at Step S210), the main control unit 21 advances the process to Step S212. In the present embodiment, the cumulative frequency in the process history table is incremented by 1 if there is the error amount. However, the process can be changed so that the cumulative frequency in the process history table is incremented by 1 when the error amount exceeds a predetermined error amount.

At Step S211, the main control unit 21 exerts control on the operation of the display control unit 22 to display a counting result and error amount screen on the display and operating unit 8. The display control unit 22 exerts control on the display and operating unit 8 to display the deposit amount inputted through the operation of the display and operating unit 8, the count amount obtained as a result of the counting process, and the error amount between the deposit amount and the count amount, and thereafter advances the process to Step S213.

At Step S212, the main control unit 21 exerts control on the display control unit 22 to display a counting result screen on the display and operating unit 8. The display control unit 22 exerts control on the display and operating unit 8 to display the deposit amount inputted through the operation of the display and operating unit 8 and the count amount obtained as a result of the counting process, and thereafter advances the process to Step S213.

At Step S213, the main control unit 21 refers to the process history table corresponding to the cash register No. entered at Step S202 and determines whether a predetermined error detection frequency (cumulative frequency of detection of the error amount exceeding the predetermined threshold value) is greater than or equal to the prescribed value (three, in the present embodiment). If the predetermined error detection frequency is greater than or equal to the prescribed value (Yes at Step S213), the main control unit 21 advances the process to Step S214, and otherwise (No at Step S213), advances the process to Step S215.

At Step S214, the main control unit 21 refers to the process history table corresponding to the cash register No. entered at Step S202, exerts control on the operation of the display control unit 22 to display, on the display and operating unit 8, a cash register No. and operator ID screen (see FIG. 4I). The screen displays the cash register No. and the operator ID of the cash registers 1 to 3 whose cumulative frequency, indicating the number of times when the error amount has exceeded the predetermined threshold value, exceeds the prescribed value as an alarm display. Thereafter, the main control unit 21 advances the process to Step S215.

At Step S215, the main control unit 21 determines whether a confirmation operation has been performed on the display and operating unit 8, and if no confirmation operation has been performed (No at Step S215), repeats Step S215 until the confirmation operation is performed.

If it is determined that the confirmation operation has been performed (Yes at Step S215), the main control unit 21 stores the counting result of the counting process performed at Step S209 in the process history table, and thereafter removes the processing day selected at Step S205 from the no-deposit day to be displayed on the display and operating unit 8 (Step S216), and ends the process.

If it is determined at Step S203 that there are no no-deposit days, the main control unit 21 stores the date of the current day and the count amount of the counting process performed at Step S209 in an associated form in the process history table pertaining to the cash registers 1 to 3 from which the currency that was subjected to the counting process was collected.

If it is determined at Step S203 that there are no-deposit days, the main control unit 21 stores the date of the processing day (no-processing day) selected at Step S205 and the counting result of the counting process performed at Step S209 in an associated form in the process history table pertaining to the cash registers 1 to 3 from which the currency that was subjected to the counting process was collected.

Furthermore, if it is determined at Step S210 that there is an error amount, the main control unit 21 stores the error amount and the processing day (current day or the processing day selected at Step S205) in an associated form in the process history table pertaining to the cash registers 1 to 3 from which the currency that was subjected to the counting process was collected.

Thus, in the cash recycler 4 according to the present embodiment, if there is a plurality of days on which the counting process of the sales proceeds could not be performed, the concerned dates when the counting process could not be done are displayed on the display and operating unit 8. The user, such as a teller, can select the desired date from the displayed dates so that the counting process of the sales proceeds of the selected date can be performed by the cash recycler 4.

Thus, the user of the cash recycler 4, such as a teller, can easily find the dates on which no counting process of the sales proceeds was performed by merely checking the display on the display and operating unit 8 of the cash recycler 4, and can easily perform the counting of the sales proceeds for the corresponding date by merely selecting the desired date on the screen. Consequently, the complexity of the task is reduced when using the cash recycler 4 to perform the counting process of the sales proceeds of a plurality of days all at once, on a sales day basis.

In the cash deposit process shown in FIG. 6, the cash deposit process is shown to have ended after completion of the cash deposit process once. However, when there is a plurality of no-processing days, the cash deposit process can be made to end after the counting processes are completed for all the no-processing days.

In the latter case stated above, the process procedure is modified in that at Step S215 of FIG. 6, if it is determined that a confirmation operation has been performed (Yes at Step S215), the process returns to Step S203, and further at Step S203, if it is determined that there are no no-processing days (No at Step S203), the cash deposit process is ended.

By modifying the process procedure of the cash deposit process as described above, when there is a plurality of no-processing days, the counting processes of the sales proceeds of all the no-processing days can be performed continuously one after another. Consequently, the workload on the user of the cash recycler 4 can be further reduced.

The cash dispensing process performed by the cash recycler 4 according to the present embodiment is explained next with reference to FIGS. 7A to 7G and FIG. 8. A flow of a sequence of operations performed by the teller using the cash recycler 4 for dispensing the currency is explained with reference to FIGS. 7A to 7G. Thereafter, the cash dispensing process performed at Step S106 of FIG. 5 is explained in detail with reference to FIG. 8.

FIGS. 7A to 7G are examples of graphics displayed on the display and operating unit 8 when the teller performs a cash dispensing operation. FIG. 8 is a flowchart of the process performed by the cash recycler 4 according to the present embodiment.

Figure 7A:
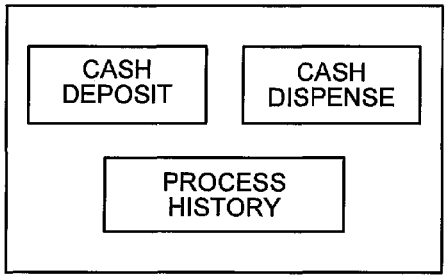
FIGS. 7A to 7G are examples of graphics displayed on the display and operating unit when the teller performs a cash dispensing operation.
Figure 7B:
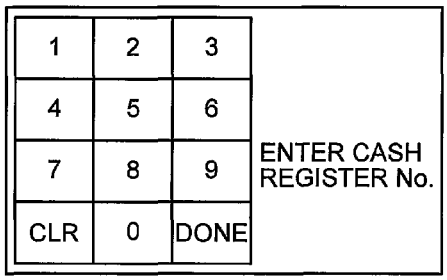
Figure 8:
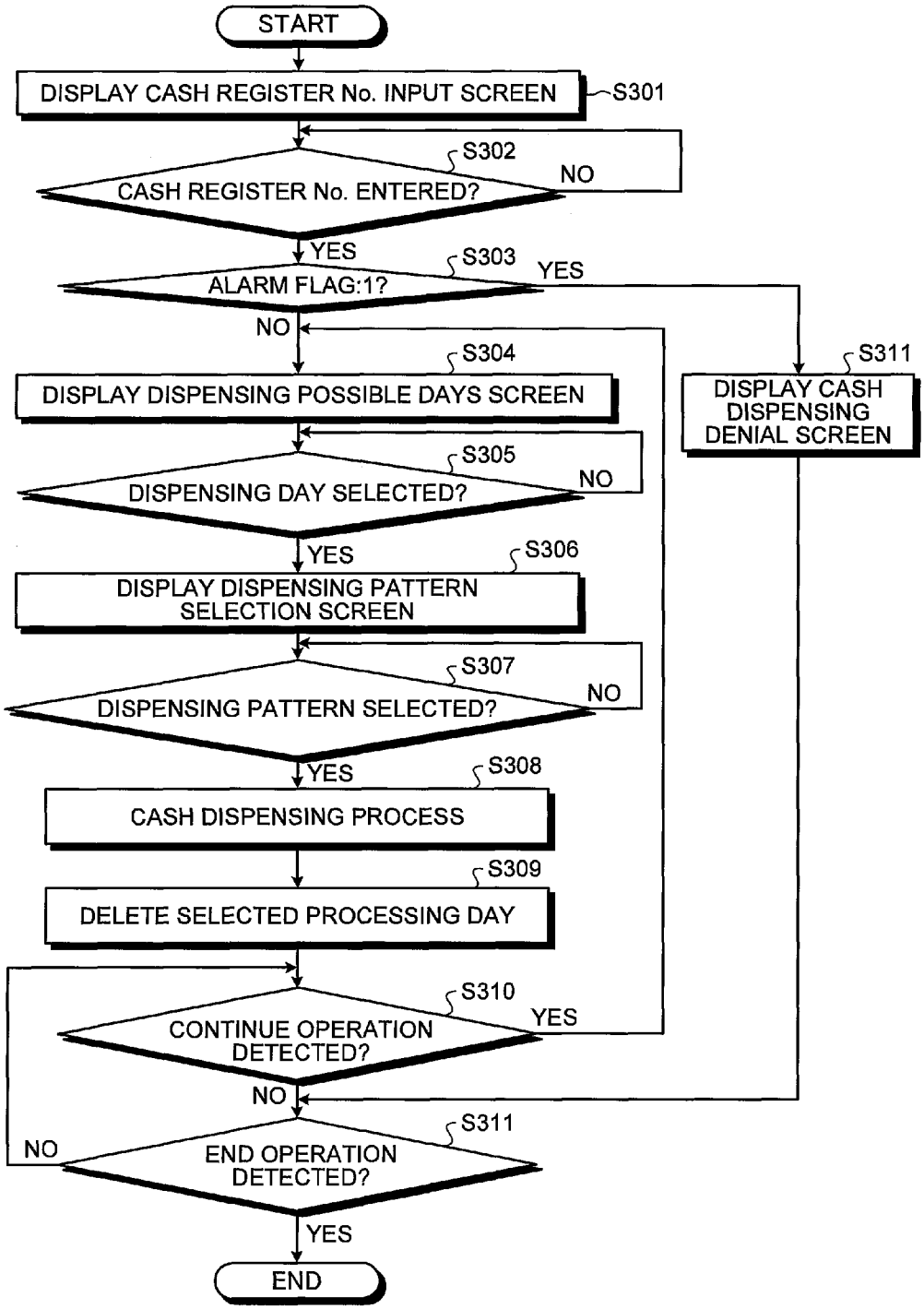
FIG. 8 is a flowchart of a cash dispensing process according to the present embodiment.

In the standby mode, when the teller touches the option "Cash Dispensing" from among the options "Cash Deposit", "Cash Dispensing", and "Process History" displayed on the display and operating unit 8, as shown in FIG. 7A, to perform the cash dispensing operation, the cash recycler 4 displays, on the display and operating unit 8, the prompt "Enter cash register No." with the infographic prompting the teller to enter the identification information of the cash registers 1 to 3, as shown in FIG. 7B.

Assuming that the teller enters "01", which is the identification information of the cash register 1, using the numerical keypad on the screen, and confirms it by touching the option "Done". The cash recycler 4 displays, on the display and operating unit 8, a dispensing possible days screen which indicates information pertaining to no-processing days on and after the current day for which the cash recycler 4 can dispenses currency within a preset upper limit on the dispensing amount.

In the present embodiment, the upper limit on the dispensing amount for one cash register is set as an amount equivalent to the change fund for next three days from the current day, including the current day. Though the number of days pertaining to setting the upper limit is taken as three in the present embodiment, it can be any number of days. Instead of the number of days, the upper limit can be set in terms of the total amount of currency or the number of currency of each denomination to be dispensed.

Figure 7C:
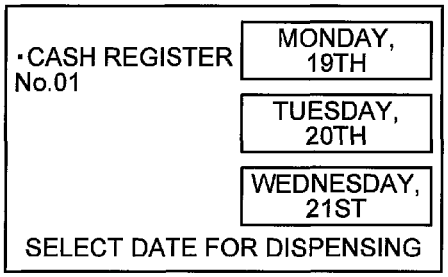

As shown in FIG. 7C, the display and operating unit 8 displays, as the dispensing possible days screen, the options "Monday, the 19th" that is the current day, "Tuesday, the 20th", and "Wednesday, the 21st", for the user, that is the teller, to select any one of the options for dispensing the change fund.

When the teller enters the cash register No. (cash register No. 01, in this example), the cash recycler 4 according to the present embodiment refers to the process history table (see FIG. 3) corresponding to the cash register No. and determines whether "1" is set in the alarm flag. If "1" is set in the alarm flag, the cash recycler 4 displays, on the display and operating unit 8, a cash dispensing denial screen with a message "Dispensing process is forbidden!", as shown in FIG. 7G. If "0" is set in the alarm flag, the dispensing possible days screen shown in FIG. 7C is displayed on the display and operating unit 8.

Figure 7D:
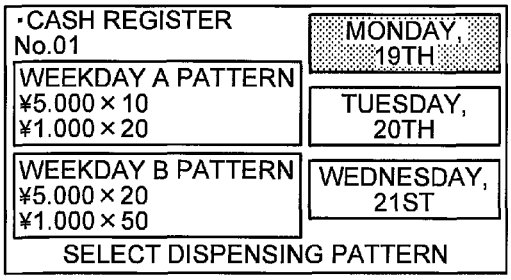

Thereafter, when the teller touches the option "Monday, the 19th" on the dispensing possible days screen, the cash recycler 4 displays, on the display and operating unit 8, a dispensing pattern selection screen for the teller to select a combination pattern of the denomination and the numerical quantity of the currency to be dispensed from the cash recycler 4, as shown in FIG. 7D.

Two options, namely "Weekday A pattern" and "Weekday B pattern" are displayed as the dispensing pattern selection screen on the display and operating unit 8 for selecting by the teller in the present embodiment. When the teller touches the option "Weekday A pattern", the cash recycler 4 performs the cash dispensing operation to disburse 10 notes of 5000 Yen and 20 notes of 1000 Yen. When the teller touches the option "Weekday B pattern", the cash recycler 4 performs the cash dispensing operation to disburse 20 notes of 5000 Yen and 50 notes of 1000 Yen. Thus, in the present embodiment, the display and operating unit 8 functions as a dispensing pattern selecting unit for selecting the combination pattern of the denomination and the numerical quantity of the valuable medium to be dispensed by the valuable-medium processing unit. A different dispensing pattern can be set for weekdays and holidays.

Figure 7E:
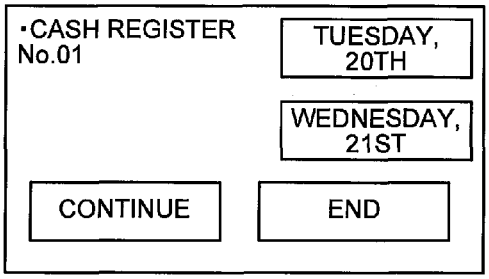

Once the cash dispensing process has ended, the cash recycler 4 displays, on the display and operating unit 8, an infographic for selecting whether to continue the cash dispensing operation for the cash register 1 with the cash register No. 01, as shown in FIG. 7E.

Figure 7F:
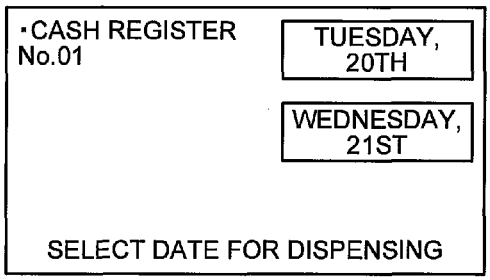
Figure 7G:
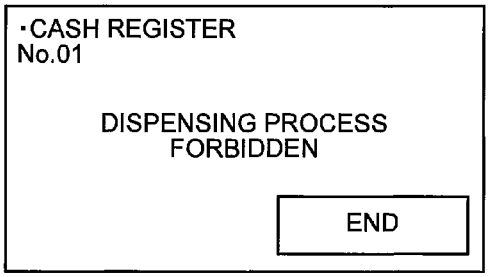

If the teller touches the option "Continue" in the infographic shown in FIG. 7E, the cash recycler 4 displays, on the display and operating unit 8, the dispensing possible days screen, as shown in FIG. 7F. Thereafter, the cash recycler 4 either ends the cash dispensing process for all the dispensing possible days or repeatedly performs display of the dispensing pattern selection screen, the cash dispensing process, and the display of the dispensing possible days screen until the teller performs an end operation. The dates for which the cash dispensing process has already been performed or cash dispensing is forbidden are either not displayed on the display and operating unit 8 or, even if displayed, rendered not selectable.

Thus, in the cash recycler 4 according to the present embodiment, when the teller performs the cash dispensing operation, the change fund can be dispensed for a plurality of days ahead of the current day, including the current day. Consequently, the complexity of the task of the dispensing operation for a plurality of days can be reduced.

Furthermore, in the cash recycler 4, the information pertaining to the no-processing days, from the current day onward, for which the cash recycler 4 can dispense currency within a preset upper limit of the dispensing amount is displayed on the display and operating unit 8. The cash dispensing process for limitless number of days ahead can be prevented from being performed.

Furthermore, in the cash recycler 4, the combination patterns of the denomination and the numerical quantity of the currency to be dispensed are preset and the desired dispensing pattern is selectable from among a plurality of the dispensing patterns by the teller. So the denomination and the numerical quantity of the currency can be dispensed according to the number of prospective customers, and the dispensing amount and the number of currency need not be inputted one by one. If the number of banknotes inside the cash recycler 4 that is the valuable-medium processing apparatus does not satisfy the number of banknotes set as the dispensing pattern, those patterns can be kept from being displayed or rendered not selectable.

Furthermore, in the cash recycler 4, when performing the cash dispensing process, the process history table is referred to and the cash dispensing process is performed only if "0" is set in the alarm flag, and if "1" is set in the alarm flag, the cash dispensing process is forbidden. Consequently, currency cannot be dispensed to a cash register or the cashier operating a cash register of which error amount in the counting result exceeds the predetermined threshold value.

In the present embodiment, the cash dispensing process is performed or forbidden based on the alarm flag stored in the process history table. However, the criterion for deciding whether or not to allow the cash dispensing process can be the error amount between the deposit amount and the count amount stored in the process history table. That is, the cash dispensing process can be allowed if the error amount is less than or equal to the predetermined threshold value and forbidden if the error amount exceeds the predetermined threshold value.

The cash dispensing process performed at Step S106 of FIG. 5 is explained in detail with reference to FIG. 8. Once the cash dispensing process starts, as shown in FIG. 8, the main control unit 21 exerts control on the display control unit 22 to display, on the display and operating unit 8, the cash register No. input screen (see FIG. 7B) that prompts input of the cash register No. of a specific cash register from among the cash registers 1 to 3 (Step S301).

Thereafter, the main control unit 21 determines whether a cash register No. has been entered (Step S302), and if no cash register No. has been entered (No at Step S302), repeats Step S302 until a cash register No. is entered, and once a cash register No. is entered (Yes at Step S302), advances the process to Step S303.

At Step S303, the main control unit 21 refers to the process history table pertaining to the cash register corresponding to the cash register No. entered at Step S302 to determine if "1" is stored as the alarm flag, and if "1" is stored (Yes at Step S303), causes the display and operating unit 8 to display the cash dispensing denial screen (see FIG. 7G), and thereafter advances the process to Step S311.

If "0" is stored as the alarm flag (No at Step S303), the main control unit 21 causes the display and operating unit 8 to display the dispensing possible days screen (see FIG. 7C) (Step S304), and thereafter advances the process to Step S305. That is, when the option "Cash Dispensing" on the screen is operated to request for cash dispensing, the main control unit 21 refers to the alarm flag stored in the process history table to determine whether the status allows cash dispensing.

At Step S305, the main control unit 21 determines whether a dispensing day has been selected from the dispensing possible days screen, and if a dispensing day has not been selected (No at Step S305), repeats Step S305 until a dispensing day is selected.

If a dispensing day has been selected (Yes at Step S305), the main control unit 21 causes the display and operating unit 8 to display the dispensing pattern selection screen (see FIG. 7D) (Step S306), and thereafter advances the process to Step S307.

At Step S307, the main control unit 21 determines whether a dispensing pattern has been selected, and if a dispensing pattern has not been selected (No at Step S307), repeats Step S307 until a dispensing pattern has been selected.

If a dispensing pattern has been selected (Yes at Step S307), the main control unit 21 performs the cash dispensing process to dispense the predetermined number of currency of the predetermined denominations according to the selected dispensing pattern (Step S308). Thereafter, the main control unit 21 causes the display and operating unit 8 to delete the dispensing day (selected processing day) selected at Step S305 from the display screen and display the infographic for selecting whether to continue or end the cash dispensing process (see FIG. 7E) (Step S309).

Thereafter, the main control unit 21 determines whether a continue operation has been performed for continuing the cash dispensing process (Step S310), and if the continue operation has been performed (Yes at Step S310), returns the process to Step S304.

If the continue operation has not been performed (No at Step S310), the main control unit 21 determines whether the end operation for ending the cash dispensing process has been performed (Step S311), and if the end operation has not been performed (No at Step S311), returns the process to Step S310, and otherwise (Yes at Step S311), ends the process.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

For example, although the cash recycler 4 in the embodiment described above is provided with both cash deposit function and cash dispensing function, the cash recycler can be provided with either only the cash deposit function or only the cash dispensing function.

The cash recycler 4 in the embodiment described above includes the denomination-wise storage unit 29. However, the storage unit for storing the valuable medium can be omitted from the structure of the cash recycler 4. In a cash recycler without the storage unit, the valuable medium deposited from outside can be dispensed to outside after the counting process, and a counting process result can be managed without storing the valuable medium inside the cash recycler.

All the automatic processes explained in the present embodiment can be, entirely or in part, carried out manually by a known method. Similarly, all the manual processes explained in the present embodiment can be, entirely or in part, carried out automatically by a known method. The process procedures, the control procedures, specific names, and data including various parameters, mentioned in the description and drawings can be changed as required unless otherwise specified.

The constituent elements of the apparatus illustrated are merely conceptual and may not necessarily physically resemble the structures shown in the drawings. For instance, the apparatus need not necessarily have the structure that is illustrated. The apparatus as a whole or in parts can be broken down or integrated either functionally or physically in accordance with the load or how the apparatus is to be used. The process functions performed by the apparatus can be entirely or partially realized by a CPU or a computer program executed by the CPU or by a hardware using wired logic.

The invention claimed is:

1. A valuable-medium processing apparatus comprising:

a valuable-medium processing unit that performs a deposit process of a valuable medium included in sales proceeds to obtain a total value of a plurality of the valuable media;

a storage unit that stores therein date information pertaining to the deposit process;

a display unit that displays the date information pertaining to the deposit process;

an input unit for selecting specific past date information out of the date information displayed on the display unit;

a display control unit that displays a current date on the display unit; and a control unit that stores a processing result of the deposit process as the sales proceeds under the current date in the storage unit, wherein when there is a past date under which the sales proceeds have not been stored in the storage unit, the past date is displayed on the display unit in addition to the current date, and when the past date is selected by the input unit and the deposit process is performed by the valuable-medium processing unit, the control unit stores the processing result of the deposit process as the sales proceeds under the past date in the storage unit.

2. The valuable-medium processing apparatus according to claim 1, wherein the valuable-medium processing unit counts and processes a numerical quantity and a kind of the valuable medium collected from a cash register.

3. The valuable-medium processing apparatus according to claim 1, wherein the valuable-medium processing unit counts a total amount or a total value of the valuable medium collected from a cash register.

4. The valuable-medium processing apparatus according to claim 1, further comprising:

a numerical-quantity receiving unit that receives a numerical quantity and a kind of the valuable medium;

an information receiving unit that receives information pertaining to a cash register; and an error detecting unit that detects an error by comparing the processing result by the valuable-medium processing unit and the numerical quantity and the kind of the valuable medium received by the numerical-quantity receiving unit, wherein the control unit stores, when the error was detected by the error detecting unit, information pertaining to the error and the information pertaining to the cash register of which the error was detected in the storage unit.

5. The valuable-medium processing apparatus according to claim 1, further comprising:

a value receiving unit that receives a total amount or a total value of the valuable medium;

an information receiving unit that receives information pertaining to a cash register; and an error detecting unit that detects an error by comparing the processing result obtained by the valuable-medium processing unit and the total amount or the total value of the valuable medium received by the value receiving unit, wherein, when the error was detected by the error detecting unit, the control unit stores in the storage unit information pertaining to the error and the information pertaining to the cash register of which the error was detected.

6. The valuable-medium processing apparatus according to claim 4, wherein the display control unit displays on the display unit the information stored in the storage unit pertaining to the error and the information pertaining to the cash register of which the error was detected.

7. The valuable-medium processing apparatus according to claim 4, wherein the display control unit displays on the display unit the information stored in the storage unit, which includes the error that exceeds a predetermined threshold value, and the information pertaining to the cash register of which the error was detected.

8. The valuable-medium processing apparatus according to claim 1, wherein the valuable-medium processing unit includes:

a recognition unit that recognizes a deposited valuable medium; and a valuable-medium storage unit that stores therein the valuable medium recognized by the recognition unit.

9. The valuable-medium processing apparatus according to claim 1, further comprising:

a dispensing requesting unit that issues a dispensing request to the control unit for dispensing the valuable medium, wherein the control unit, upon receiving the selected date and the dispensing request and determining that the valuable medium can be dispensed, exerts control on the valuable-medium processing unit to dispense the valuable medium.

10. The valuable-medium processing apparatus according to claim 4, wherein the control unit exerts control on the valuable-medium processing unit to dispense the valuable medium when information pertaining to the error stored in the storage unit is less than or equal to a predetermined threshold value.

11. The valuable-medium processing apparatus according to claim 4, wherein the information pertaining to the cash register includes identification information of the cash register and operator information of the cash register.

12. The valuable-medium processing apparatus according to claim 5, wherein the display control unit displays on the display unit the information stored in the storage unit pertaining to the error and the information pertaining to the cash register of which the error was detected.

13. The valuable-medium processing apparatus according to claim 5, wherein the display control unit displays on the display unit the information stored in the storage unit, which includes the error that exceeds a predetermined threshold value, and the information pertaining to the cash register of which the error was detected on the display.

14. The valuable-medium processing apparatus according to claim 5, wherein the control unit exerts control on the valuable-medium processing unit to dispense the valuable medium when information pertaining to the error stored in the storage unit is less than or equal to a predetermined threshold value.

15. The valuable-medium processing apparatus according to claim 5, wherein the information pertaining to the cash register includes identification information of the cash register and operator information of the cash register.

* * * * *